US005216770A

United States Patent [19]

Holt

[11] Patent Number: 5,216,770

[45] Date of Patent: Jun. 8, 1993

[54] SUPPORT DEVICE

[76] Inventor: William J. Holt, 4216 Barnett St., Philadelphia, Pa. 19135

[21] Appl. No.: 850,337

[22] Filed: Mar. 11, 1992

[51] Int. Cl.[5] ..... A61G 13/00

[52] U.S. Cl. ..... 5/639; 5/638; 5/490; 128/202.18

[58] Field of Search ..... 5/636, 638, 639, 641, 5/423, 468, 469, 490; 128/202.18

[56] References Cited

U.S. PATENT DOCUMENTS

| | | | |
|---|---|---|---|
| 2,446,396 | 8/1948 | Waranch | 5/490 |
| 2,917,046 | 12/1959 | Fairbanks | 5/641 X |
| 3,319,272 | 5/1967 | Eller | 5/639 |
| 3,377,103 | 4/1968 | Borton et al. | 5/469 X |
| 3,482,571 | 12/1969 | Behrendt | 128/202.18 |
| 4,206,524 | 6/1980 | Cook | 5/469 X |
| 4,312,087 | 1/1982 | De Geus | 5/490 |
| 4,752,064 | 6/1988 | Voss | 5/638 |
| 4,788,728 | 12/1988 | Lake | 5/490 X |
| 5,095,569 | 3/1992 | Glenn | 5/638 X |

FOREIGN PATENT DOCUMENTS

| | | | |
|---|---|---|---|
| 1420221 | 1/1976 | United Kingdom | 5/434 |

OTHER PUBLICATIONS

Infant Nasal CPAP Cannula (Hudson).

Infant Nasal Cannulae (INCA) Assembly for CPAP Ackrad Laboratories, Inc. Cranford, N.J. 07016.

Infant Nasal CPAP Cannula No. 1690 (Hudson Respiratory Care Inc.), Temecula Calif. 92390-0740.

*Primary Examiner*—Michael F. Trettel

*Attorney, Agent, or Firm*—Paul & Paul

[57] ABSTRACT

A body support device having a resilient surface with channels disposed in the surface for retaining tubing therein.

10 Claims, 3 Drawing Sheets

SUPPORT DEVICE

BACKGROUND OF THE INVENTION

1. Field of the Invention

The present invention relates to a body support device.

2. Description of the Prior Art

Individuals have relied on support devices when lying down on a bed, sofa or other reclining apparatus or surface. Generally, such supports are made of a resilient or compressible material which accords comfort to the user. An important quality of a support is its ability to conform to the portion of the body which it has been employed to provide comfort. Supports in the form of pads or pillows are commonly used in the home, and in addition, have widespread use in medical facilities, such as, for example, hospitals where patients are likely to spend a great deal of time resting or recovering in a bed. Throughout hospitals, in both pediatric and adult wards, supports, such as pillows, are used to provide comfort for patients.

In infant care units, supports, such as pads or pillows are often used in connection with incubator units to provide a cushioned surface for accommodating the body part of an infant, such as the infant's head. A support device, such as a pillow or pad, is generally placed on top of the incubator mattress on which the infant rests. While a pad or pillow is employed to provide comfort for an infant user, standard pillows presently in use are not appropriate in certain infant care applications, and in fact may actually cause the infant user much discomfort.

When infants are born premature, an incubator such as a radiant warmer bed or overhead radiant warmer is used as an environment in which to maintain the infant until the infant reaches term, a time period which may often take up to about eight to ten weeks. A ventilator system, such as a continuous positive airway pressure system (or CPAP system), must be used to supply a pressure of oxygen or air to the infant while it is lying in the incubator. The infant therefore must accommodate a series of air transport tubes (or cannula system) which often includes a pair of tubular prong-like fittings for receipt in the infant's nasal openings. When the infant is resting on its back, its head may rest on a support, such as a pad or pillow, and the tubes may rest along side of, or over, the infant's head. In some instances a cap which has tube-holding members on it is provided to be worn by the infant in order to retain the tubes in position.

However, an infant cannot remain on its back at all times, or for extended lengths of time. An infant's position therefore must be changed several times during the course of a day. An advisable position for the infant to be placed is the fetal position (on its side). However, the ventilating tubes which must remain in place, often provide a nuisance as well as a health hazard to the infant. If the infant is placed on its side, its head continues to rest on a support, such as a pillow, however the tubes may become sandwiched between the infant's face and the pillow. Since the air or oxygen must be constantly supplied to the infant, the tubes cannot be removed. Additionally, any attempt to change the position of the ventilator tubes merely places additional pressure against the infant's nose.

The infant must therefore bear the discomfort of having a tube placed between its face and the support pillow. As a result, an infant may experience physical problems, in addition to the actual discomfort felt by the tube pressing into the side of its face. Nasal septum necrosis is a common effect of the stress transmitted by the tubing against the infant's nose. When the infant is positioned on its side and the infant's head is resting on the tubing, the prongs which are situated within the infant's nose may be forced against the septum and walls of the nasal cavity. In many cases this causes trauma to the infant's nose, which, being extremely delicate at this stage of the infant's life, is therefore very susceptible to damage brought about by the pressure of the tubing. Often the resultant damage to an infant's nose can be quite severe, causing open sores, and in many cases even deteriorating the nasal septum to such a great extent that corrective surgery, such as plastic or reconstructive surgery, becomes necessary.

To accommodate the tubing and provide comfort to the infant, medical personnel have on occasion positioned wadded-up diapers on the sides of the infant's head. However, the diapers are difficult to maintain in place, and furthermore often themselves press against the infant's head. In addition, the diapers do not adequately provide relief from the problems associated with the tubing.

SUMMARY OF THE INVENTION

The present invention provides a body support device which has means for receiving and accommodating tubing within the support device. The present invention when used in connection with an infant ventilator system permits tubing which would otherwise be forced against an infant's face to be recessed within the support device when the infant's head is resting on the support device.

It is a primary object of the present invention to provide a support for a body or body portion.

It is another object of the present invention to provide a body support device which has means for accommodating tubing.

It is a further object of the present invention to provide a body support device which has means for accommodating tubing therein at a level about equal to or below the surface level of the body support.

It is another object of the present invention to accomplish any of the above objects wherein the tubing comprises ventilator tubing such as a continuous positive airway pressure system used in delivering air or oxygen to premature infants.

A further object of the present invention is to provide a support device which has a removable contoured cover which may be placed over the surfaces of the support device.

DETAILED DESCRIPTION OF THE PREFERRED EMBODIMENTS

Figure 1:
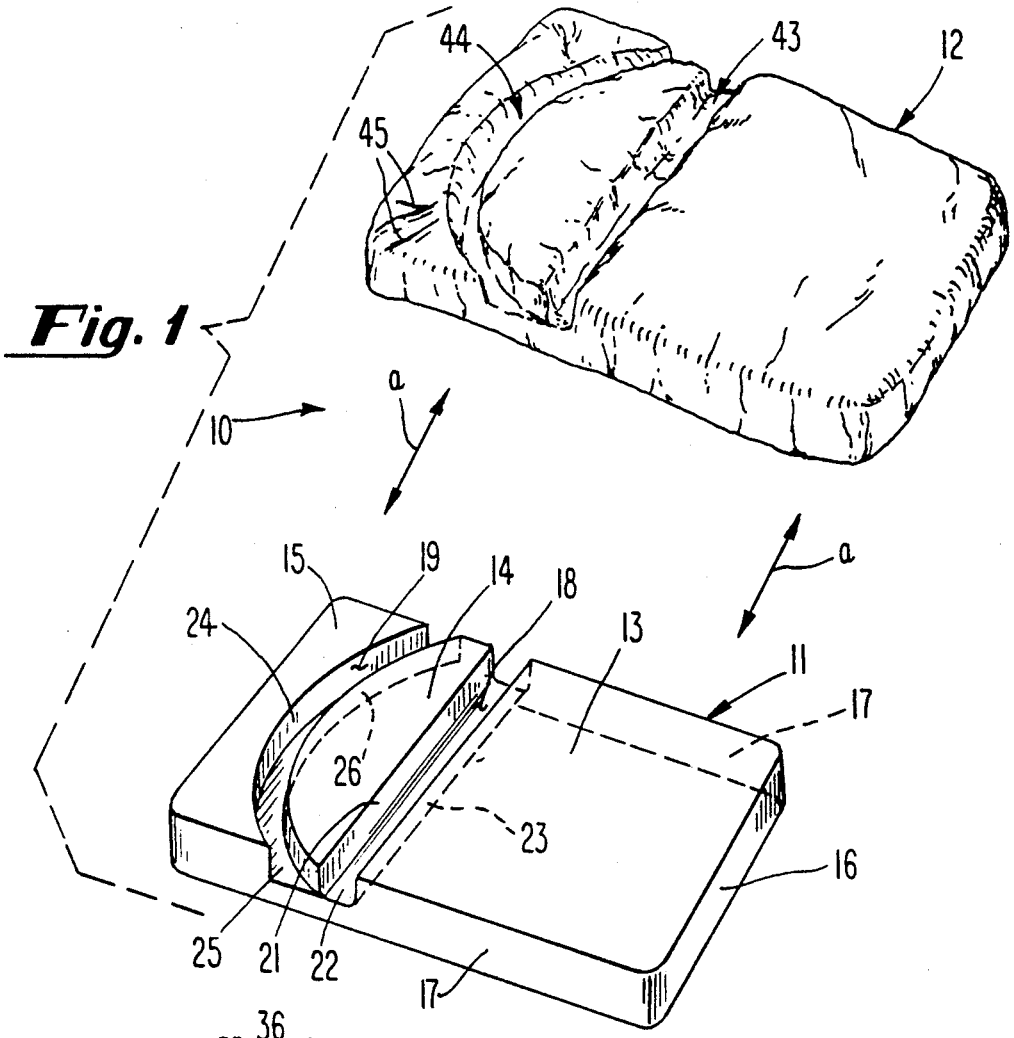
FIG. 1 is an exploded perspective view of an embodiment of the present support device showing the base portion and removable cover member.

Referring now to FIG. 1, the preferred embodiment of the present support device 10 is shown comprising a base member 11 and a cover member 12 The base member 11 is preferably provided comprising any suitable soft or resilient material such as, for example, a foam rubber material. As seen in FIG. 1, the base member 11 is provided having upper surface portions 13, 14 and 15, each of which provides an area upon which a body portion, such as an infant's head 30 (seen in dotted line representation in FIG. 3), may rest. Sidewall portions 16 and 17 are shown, each sidewall portion being provided in pairs, such that opposite the sidewall portions 16 and 17, there are similar sidewall portions. The base member 11 in an alternate embodiment (not shown) may be provided having one continuous sidewall, such as for example where the base member 11 comprises a round or oval configuration.

Figure 2:
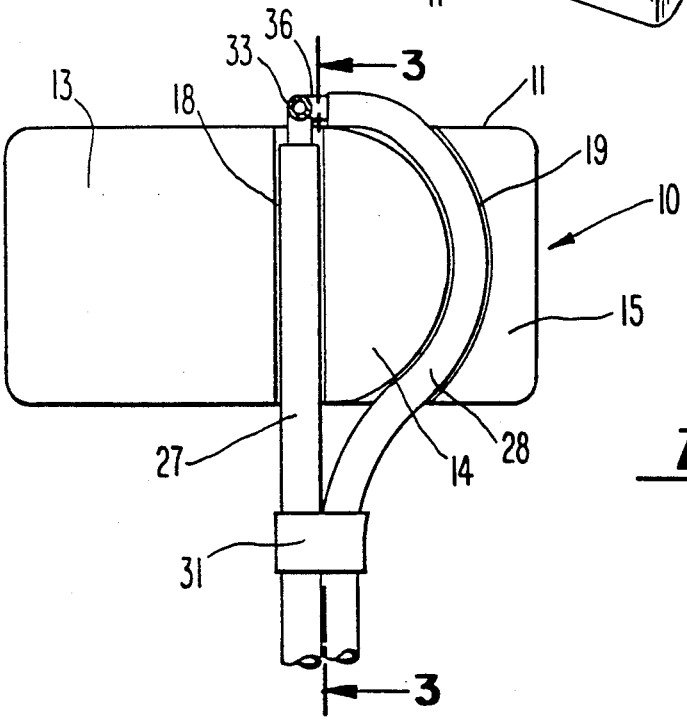
FIG. 2 is a top plan view of the present support device taken through the connecting tube along the line 2—2 of FIG. 3, showing tubing employed for use with the support device.

The base member 11 is provided with tube-receiving means for accommodating a tube (such as any of those 27 and 28 shown in FIG. 2, or 32 shown in FIG. 3) therein. The tube-receiving means are shown preferably comprising first and second channels, respectively 18 and 19, which are disposed within the base member 11 and extend between and through each opposite sidewall portion 17 of the base member 11. A straight first channel 18 is shown transversely extending from one sidewall portion 17 of the base member 11 to the opposite sidewall portion 17. The first channel 18 is shown defined by a pair of opposing vertical wall portions 21 and 23 (shown in dotted lines), and a horizontal or connecting wall portion 22. The vertical wall portions 21 and 23 along with the connecting wall portion 22 define the first channel 18 of the tube-receiving means.

In addition, the tube-receiving means are seen in FIG. 1 also comprising a second channel 19 which extends between the pair o base sidewall portions 17. Preferably the second channel 19 is provided extending arcuately through the base member 11 as shown in FIGS. 1 and 2. Similar to the first channel 18, the second channel 19 is shown comprising opposing sidewall portions 24 and 26 and a connecting wall portion 25. Alternately, while not shown, either or both of the first and second channels 18 and 19, respectively, may be defined by a single walled portion such as for example a generally U-shaped wall portion extending through the base member 11 and recessed below the surface of the bas member 11.

Referring to FIG. 2, the present support device 10 is shown in use with ventilator tubing components, such as for example an expiratory tube 27 and a pressure monitoring tube 28. The tube-receiving means of the support device 10 accommodates the ventilation tubes 27 and 28 which are used to monitor and transfer a flow of air and/or other gases toward and away from a patient, such as the infant 30 shown in dotted line representation in FIG. 3. The tubes 27 and 28 which are used with the present support device 10, as shown, may comprise part of a cannula system for delivering a continuous positive airway pressure to an infant via the infant's nasal passages. The expiratory tube 27, for example, may comprise a duct through which exhaled air or gases are carried away from the infant's nasal passages and to a regulator means of a ventilator (not shown). The pressure monitoring tube 28, for example, may comprise a proximal pressure line which is attached to a pressure sensing device of a ventilator unit (not shown) which will monitor the amount of pressure at the infant's nasal passage way.

A fastener member, such as for example a piece of tape 31, seen in FIG. 2, retains the tubes 27 and 28 together for stability While the specific ventilator unit is not shown or described with great particularity its mention in connection with the use of the present invention will be sufficient for an understanding of the present invention by one of ordinary skill in the art.

Figure 3:
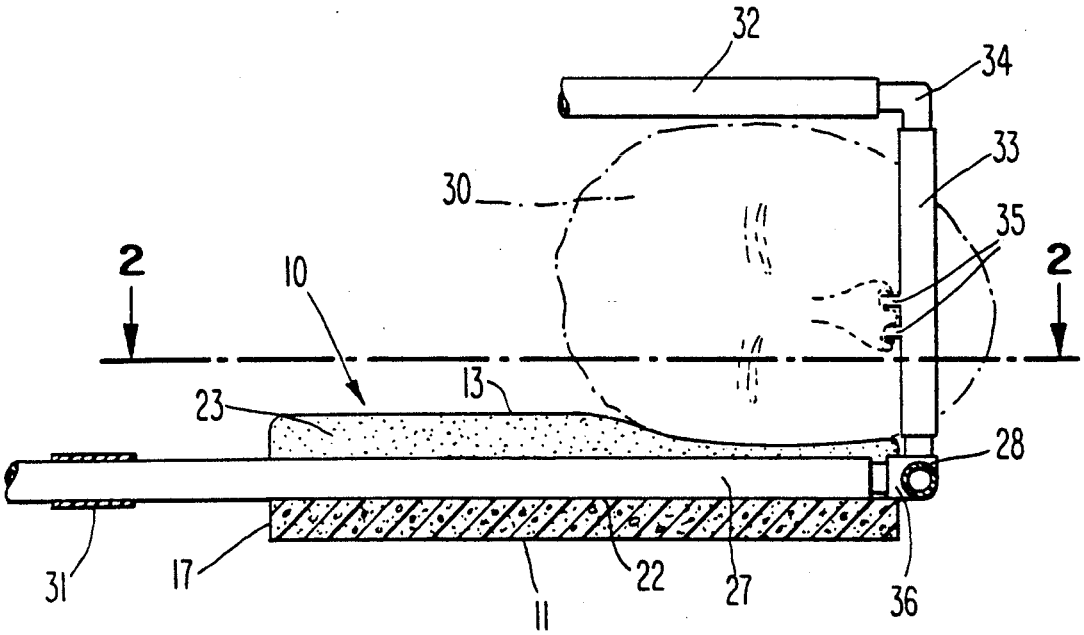
FIG. 3 is a side elevation sectional view taken along the line 3—3 of FIG. 2, showing the present support device in use with ventilation tubing on an infant (shown in dotted).

FIG. 3 shows the present support device 10 in use with an infant nasal cannula system including an inspiratory tube 27 and expiratory tube 32. The support device 10 is provided with tube-receiving means including the first channel 18 through which the expiratory tube 27 is shown extending. The connecting wall portion 22 which defines, in part, the first channel 18 supports the expiratory tube 27 which is disposed in the first channel 18. As seen in FIG. 3, the expiratory tube 27 is recessed within the first channel 18 of the tube-receiving means in order to prevent the tube 27 from protruding into the side of the infant's face.

As exemplified by FIG. 3, the support device 10 is shown used in connection with an infant nasal cannula system, where the infant, represented by the numeral 30, is positioned to rest on its side. A pressure of air is supplied by a ventilator (not shown) through the inspiratory tube 32 and passes through a connecting tube 33 which is attached to the tube 32 with the elbow connector 34. The air or gas pressure then travels through the connecting tube 33 to supply a positive pressure to the infant's nasal passages through a pair of tubular prongs 35 which extend into the infant's nasal opening. The support device 10 facilitates maintenance of the connecting tube 33 and prongs 35 in position to supply the infant with a positive pressure of air. The connecting tube 33 may for example be supplied in different sizes to accomodate the size of the individual user.

As exemplified in FIG. 3, the infant's head 30 is seen resting against the surface 13 of the base member 11. The resilience of the base member 11 facilitates absorption of the weight of the infant's head 30 such that preferably the surface 13 is at the same height or at about the same height as a tube, such as the expiratory tube 27, which is accommodated by the support device 10 when the infant's head 30 is resting on the surface. The support device 10 provides ample room in the first channel 18 for the tube 27 which would otherwise be sandwiched between the side of the infant's face and a surface.

As shown in FIG. 3, the connecting tube 33 is also attached to a connecting elbow 36 to permit communication of air or gases between the expiratory tube 27 (also attached to the elbow 36) and the connecting tube 33. The elbow 36 also provides a means for attaching the pressure monitoring tube 28 thereto, the pressure monitoring tube 28 being accommodated within the second channel 19. While not shown, the tube 28 may be supported by the connecting wall portion 25 of the second channel 19.

Although the infant 30 is shown with its head resting on the surface 13, it will be understood that the infant's head 30 may also be positioned on surfaces 14 and 15 in a similar manner. Additionally, while the expiratory tube 27 is shown resting within the first channel 18 of the tube-receiving means, it is further understood that the inspiratory tube 32 may also be received within the first channel 18 if the infant 30 were to be turned on its left side, or side opposite that shown in FIG. 3 (where the infant 30 is shown on its right side).

Figure 4:
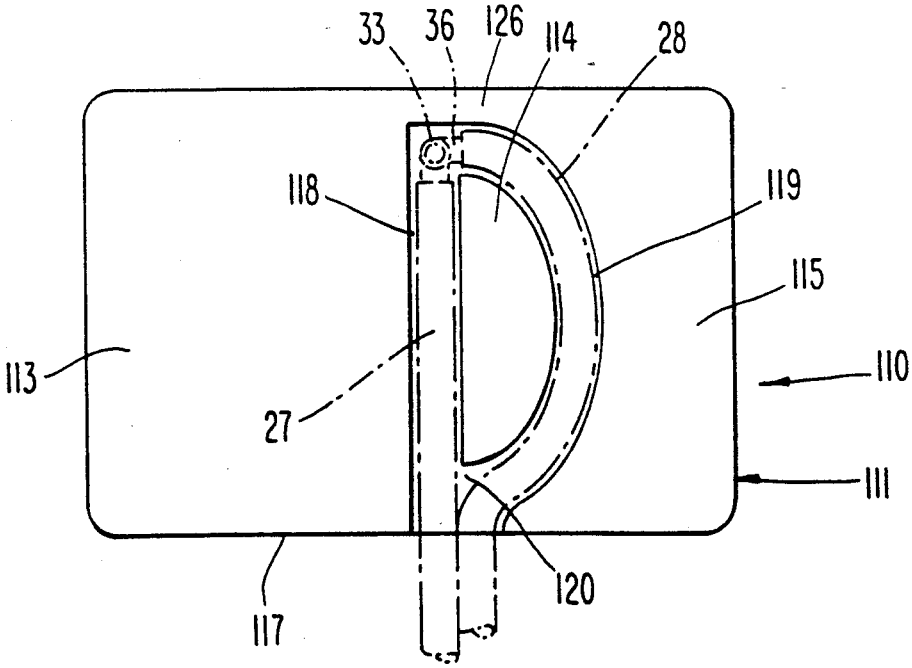
FIG. 4 is a top plan view of an alternate embodiment of a support device showing tubing (seen in phantom) in use with the device.

Referring to FIG. 4, an alternate embodiment of the support device 110 is shown comprising a base member 111 which is provided with tube-receiving means including first and second channels 118 and 119, respectively, which are disposed in the base member 111. The channels 118 and 119 may share a common passage 120 which extends through a sidewall portion 117 of the base member 111. This support device embodiment 110 permits a larger surface area to be utilized on the support device 110 when using tubes such as those 27 and 28. Channels 118 and 119 may be similar to those 18 and 19 described herein, however the channels 118 and 119 are provided to communicate with one another to form one continuous channel disposed in the base member 111. The ventilator tubing system shown in FIG. 2, and described above, is likewise shown in phantom in FIG. 4 employed with the alternate embodiment of the support device 110. The tubes 27 and 28 (shown in phantom) are respectively accommodated in the first and second channels 118 and 119. Likewise the first channel 118 may also accommodate the expiratory tube 32 seen in FIG. 3 if the infant 30 is positioned on its left side.

A removable cover 12, seen in FIG. 1, is preferably provided for removal and replacement on the base member 11 as indicated by double arrows "a". Alternately, the base member 11 may be comprised of a washable material or be provided with a washable surface to permit the use of the support device 10 without the cover 12. The cover 12 may be provided comprising a disposable material for one time throwaway use, or may be provided comprising a washable material.

Figure 5:
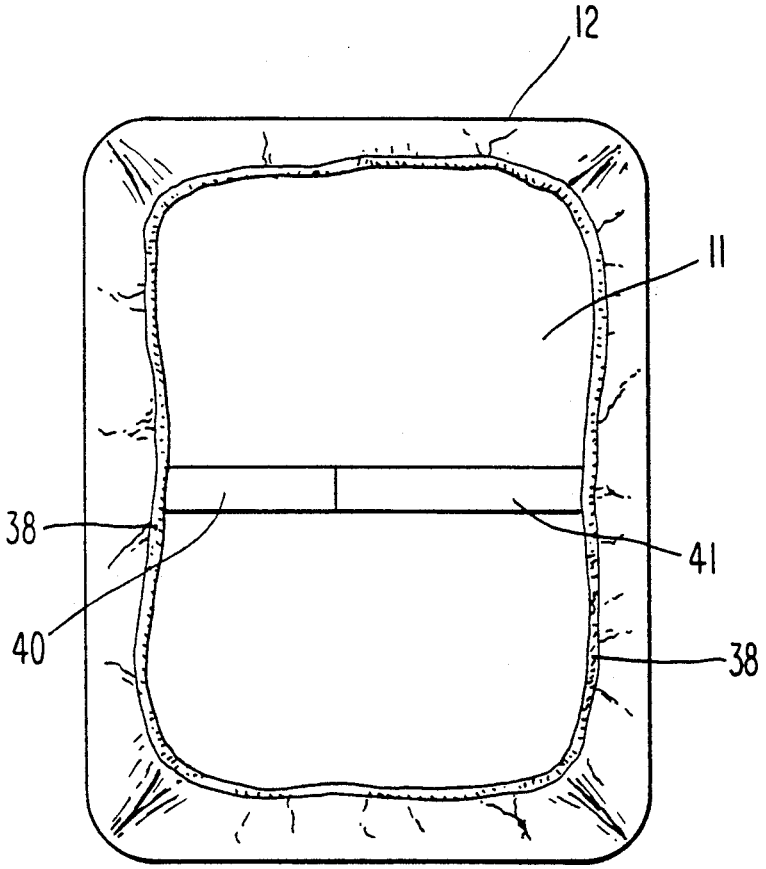
FIG. 5 is a bottom plan view of an embodiment of the present support device shown with the cover member installed.

Referring to FIG. 5, the bottom of the support device 10 is shown with the cover 12 installed over the base member 11. The cover 12 is provided with a fastening means, such as for example the elastic portion 38 seen bordering the cover member. The elastic portion 38 is stretched to fit the cover 12 over the base member 11. Once positioned over the base member 11, the stretched elastic portion 38 is allowed to relax and hold the cover 12 in place. The fastening means may also comprise strap portions 40, 41 which are shown attached to the cover 12 at opposite ends in FIG. 5. The strap portions 40 and 41 extend under the base member 11 where they are attached to one another by any suitable attachment means (not shown), such as for example, a snap, or a pile backed surface on one strap and a mat of hooks on the other.

The cover 12 is shown in FIG. 1 having a contour-fit to accommodate the first and second channels 18 and 19 respectively, such that when the cover is placed over the base member 11, the first and second channels 18 and 19 are lined with the cover 12. The cover 12 is shown having channel-accommodating zones 43 and 44 which are provided to fit within the respective channels 18 and 19 when the cover 12 is installed on the base member 11. The channel-accommodating zones 43 and 44 may for example be provided by forming pleats 45 in the cover member 12. Likewise, the cover 12 may for example be constructed from a material which can be molded to form the contoured channel-accommodating zones 43 and 44. While not shown, a cover similar to that 12 described herein may be provided for use with the alternate embodiment of the support device 110 shown in FIG. 4.

While the present invention is described in connection with use by an infant, it is understood that the present device may also be use by other individuals, including adults, as described above.

These and other variations in the form and detail of the device may be made in accordance with the invention which is to be broadly construed and to be defined by the scope of the appended claims. It will be understood that various embodiments of the invention, in addition to those mentioned herein may be provided consistent with the invention as claimed herein.

I claim:

1. A support device comprising:

a) a base member; and b) tube-receiving means disposed within said base member for receiving at least one tube therein; said tube-receiving means comprising at least two which are channels at least, in part, in side by side relation to one another disposed in said base member.

2. The support device of claim 1, further comprising a removable cover member which is adapted for installation over said base member.

3. The support device of claim 2, wherein said removable cover member further includes attachment means for installation of said cover over said base member.

4. The support device of claim 3, wherein said attachment means comprises an elastic means for stretch-fit installation of said cover member over said base member.

5. The support device of claim 1, wherein said base member comprises a resilient member.

6. A support device comprising:

a) a base member;

b) tube-receiving means disposed within said base member for receiving at least one tube therein; and c) a removable cover member which is adapted for installation over said base member;

d) wherein said cover member is provided with at least one channel-accommodating zone to facilitate lining of said channel with the cover member.

7. A support device comprising:

a) a base member;

b) tube-receiving means disposed within said base member for receiving at least one tube therein;

c) wherein said tube-receiving means comprises at least two channels disposed in said base member; and d) wherein at least one channel is linear and at least one channel is arcuate.

8. The support device of claim 7, further comprising a removable cover member which is adapted for installation over said base member.

9. A support device comprising:

a) a base member;

b) tube-receiving means disposed within said base member for receiving at least one tube therein;

c) wherein said tube-receiving means comprises a continuous channel having a linear channel portion and an arcuate channel portion.

10. The support device of claim 9, further comprising a removable cover member which is adapted for installation over said base member.

* * * * *

UNITED STATES PATENT AND TRADEMARK OFFICE

CERTIFICATE OF CORRECTION

PATENT NO. : 5,216,770
DATED : June 8, 1993
INVENTOR(S) : William J. Holt

It is certified that error appears in the above-indentified patent and that said Letters Patent is hereby corrected as shown below:

Column 6, line 21, delete "which are channels" and replace with -- channels which are --.

Signed and Sealed this

Fifth Day of April, 1994

Bruce Lehman

*Attest:*

BRUCE LEHMAN

*Attesting Officer*

*Commissioner of Patents and Trademarks*